US005863267A

United States Patent [19]

Choi

[11] Patent Number: 5,863,267

[45] Date of Patent: Jan. 26, 1999

[54] RACKET DEVICE AND ASSOCIATED METHOD OF STRINGING A RACKET

[76] Inventor: In Y. Choi, 20 Traverse Dr., Norristown, Pa. 19401

[21] Appl. No.: 998,197

[22] Filed: Dec. 24, 1997

[51] Int. Cl.[6] ..... A63B 51/12

[52] U.S. Cl. ..... 473/540; 473/834; 473/532; 473/539

[58] Field of Search ..... 473/540, 534, 473/532, 539, 557, 178

[56] References Cited

U.S. PATENT DOCUMENTS

| | | | |
|---|---|---|---|
| 1,572,542 | 2/1926 | Lawrence | 473/534 |
| 1,621,746 | 3/1927 | Morten | 473/534 |
| 1,684,449 | 9/1928 | Kleinman | 473/534 |
| 2,019,394 | 10/1935 | Clemons . | |
| 2,032,217 | 7/1932 | Matthews . | |
| 2,040,194 | 5/1936 | Whiteside . | |
| 2,091,654 | 8/1937 | Roberts . | |
| 4,140,316 | 2/1979 | Coupar | 473/540 |
| 4,340,225 | 7/1982 | Wilson | 473/534 |
| 4,455,021 | 6/1984 | Berque . | |
| 4,566,695 | 1/1986 | Melby | 473/534 |
| 4,593,905 | 6/1986 | Abel | 473/534 |
| 5,186,459 | 2/1993 | Korte-Jungermann . | |

FOREIGN PATENT DOCUMENTS

| | | | |
|---|---|---|---|
| 582861 | 10/1924 | France | 473/178 |
| 2719752 | 11/1978 | Germany | 473/178 |
| 451384 | 8/1936 | United Kingdom | 473/178 |

*Primary Examiner*—Raleigh W. Chiu
*Attorney, Agent, or Firm*—LaMorte & Associates, P.C.

[57] ABSTRACT

A racket is provided such as that used in the game of tennis, racquetball, squash, badminton and the like. The racket has a frame head that defines the periphery of a generally oblong shaped area. A plurality of apertures are periodically disposed along the frame head. In one embodiment, a plurality of set screws are disposed in the frame head. Each of the set screws intersects a separate one of the apertures and selectively obstructs that aperture depending upon the tightened condition of the set screws. In an alternate embodiment, a separate structure is provided that surrounds the head frame. The separate structure contains apertures and set screws that intersect the apertures. The opposing ends of individual strings are fed through apertures on opposite sides of the head frame. The string is tensioned to a predetermined value. Once at the desired tension, the set screws are used to engage the string and retain it in place at the set tension. The hold of the set screws prevents the string from becoming slack or otherwise retracting from the aperture through which it passes.

16 Claims, 4 Drawing Sheets

RACKET DEVICE AND ASSOCIATED METHOD OF STRINGING A RACKET

BACKGROUND OF THE INVENTION

1. Field of the Invention

The present invention relates to rackets that are used in sports activities such as tennis, racquetball, squash, badminton and the like. More particularly, the present invention relates to rackets and stringing devices for rackets that enable the racket to be strung with a plurality of individual strings.

2. Description of the Prior Art

There are many sports that are played with a racket. One of the most popular of these sports is tennis. In the game of tennis, the racket includes an oblong head section supported by a handle. A string is strung back and forth through the head section of the racket, thereby producing a mesh structure. The mesh structure creates the surface that is used in the game to contact the ball.

In the prior art, the head section of rackets are typically manufactured with periodic apertures. To create the mesh structure across the head of the racket, a single unbroken string is woven through the various apertures. As the string is being woven through the apertures in the head section of the racket, the string is kept at a preset tension that is desired by the player.

Since the stringing of a racket with a single string is a complicated process, most players have their rackets professionally strung. A professional stringer typically has a stringing machine that assists in weaving the string through the various apertures in the head section of the racket at the appropriate tension. One problem associated with having a racket professionally strung is that it is expensive and inconvenient. If the racket string breaks during a game, the player can not fix the racket string and continue with the game. Rather, a player must either change rackets or stop playing.

Recreational tennis players often own inexpensive rackets. Commonly, a recreational player can buy a cheap new prestrung racket for less money than it would cost to have their old racket professionally prestrung. However, players with expensive rackets have little choice but to restring their rackets if the string breaks. To help reduce the cost and inconvenience of having rackets professionally restrung, many devices have been developed in the prior art that enable a person to restring their own racket by themselves. Such prior art patents are exemplified by U.S. Pat. No. 2,091,654 to Roberts, entitled Apparatus For Stringing Rackets. Although such devices make it possible for a person to string his own racket, the process is still very time and labor extensive. Accordingly, if the racket string breaks during a game, the racket string can not be repaired on the spot. The player must still then either change rackets or stop playing.

When the racket string of a conventional racket breaks, the string becomes loose and leaves the weave pattern. Since only one string is used, the broken string eventually unwinds to a point where the racket is no longer functional. In U.S. Pat. No. 5,186,459 to Korte-Jungermann, entitled Process For Stringing Rackets For Ball Games And A Device For Carrying Out The Process, a racket stringing system is shown where a racket can be strung with a plurality of different strings. In the Korte-Jungermann patent a different string is used to string each vertical column and horizontal row in the mesh structure. Accordingly, if any one string broke, it would not effect the remaining strings. The device described in the Korte-Jungermann patent uses a rivet sleeve. The individual strings are tensioned through the rivet sleeves. Once at the proper tension, the rivet sleeves are compressed using a crimping tool, wherein the rivet engages the string and holds it at the preset tension. Although the system described in the Korte-Jungermann patent allows individual strings to be used in a racket, the disadvantages are many. In order to use the Korte-Jungermann system, a person must have spare rivet sleeves and a specialized crimping tool to crush the rivets around the racket string. The placement of the rivets on the string and the crimping of the rivets with the crimping tool is a complicated and time consuming procedure. Furthermore, the strength of the crimp holding the string is directly proportional to the skill of the person using the crimping tool, the manufacturing tolerances of the rivet collar and the placement of the rivet collar in the crimping tool. Consequently, the ability of the various crimped rivet collars to retain a racket string will vary from application to application and from time to time.

A need therefore exists in the art for a racket and a racket stringing system that enables a plurality of different strings to be individually applied to a racket head in a quick and easy manner without the use of a crimping tool. This need is met by the present invention as described and claimed below.

SUMMARY OF THE INVENTION

The present invention is a racket such as that used in the game of tennis, racquetball, squash, badminton and the like. The racket has a frame head that defines the periphery of a generally oblong shaped area. A plurality of apertures are periodically disposed along the frame head. In one embodiment, a plurality of set screws are disposed in the frame head. Each of the set screws intersects a separate one of the apertures and selectively obstructs that aperture depending upon the tightened condition of the set screws. In an alternate embodiment, a separate structure is provided that surrounds the head frame. The separate structure contains apertures and set screws that intersect the apertures.

The opposing ends of individual strings are fed through apertures on opposite sides of the head frame. The string is tensioned to a predetermined value. Once at the desired tension, the set screws are used to engage the string and retain it in place at the set tension. The hold of the set screws prevents the string from becoming slack or otherwise retracting from the aperture through which it passes. If a string breaks, that string can be individually removed and replaced without effecting the remainder of the strings in the racket.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device can be used in association with any strung racket, such as a racquetball racket, a squash racket, a badminton racket or the like, the present invention device is particularly well suited for use as a tennis racket. Accordingly, the exemplary embodiment of the present invention will be described in an application as a tennis racket. However, it will be understood that any other type of racket can be substituted for the tennis racket described.

Figure 1:
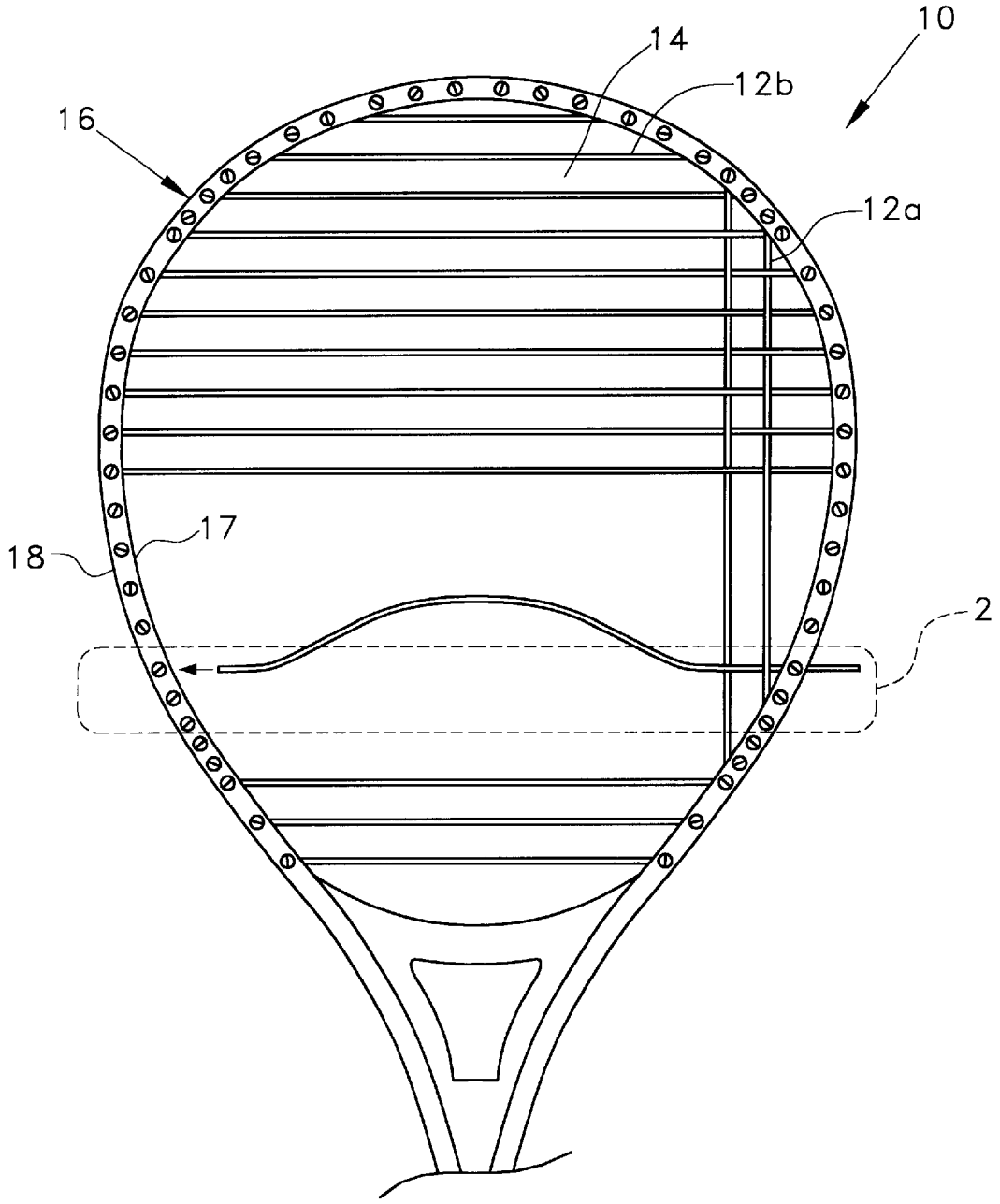
FIG. 1 is a front view of one preferred embodiment of a racket in accordance with the present invention.

Referring to FIG. 1, a tennis racket 10 is shown in accordance with the present invention. In the shown embodiment, each vertical column string 12*a* and horizontal row string 12*b* in the mesh structure 14 of the racket 10 are individual strings segments that are separate and apart from the other strings. The racket 10 includes an elliptical head section 16 that supports the column strings 12*a* and row strings 12*b* of the mesh structure. Apertures are periodically formed through the structure of the head section 16 of the racket 10. The apertures extend from the inside surface 17 of the head section 16 all the way through to the exterior surface 18 of the head section 16. The apertures are disposed as opposing pairs in the vertical and horizontal directions. Accordingly, each column string 12*a* and row string 12*b* passes through one pair of opposing apertures when set in place in the head section 16 of the racket 10.

Figure 2:
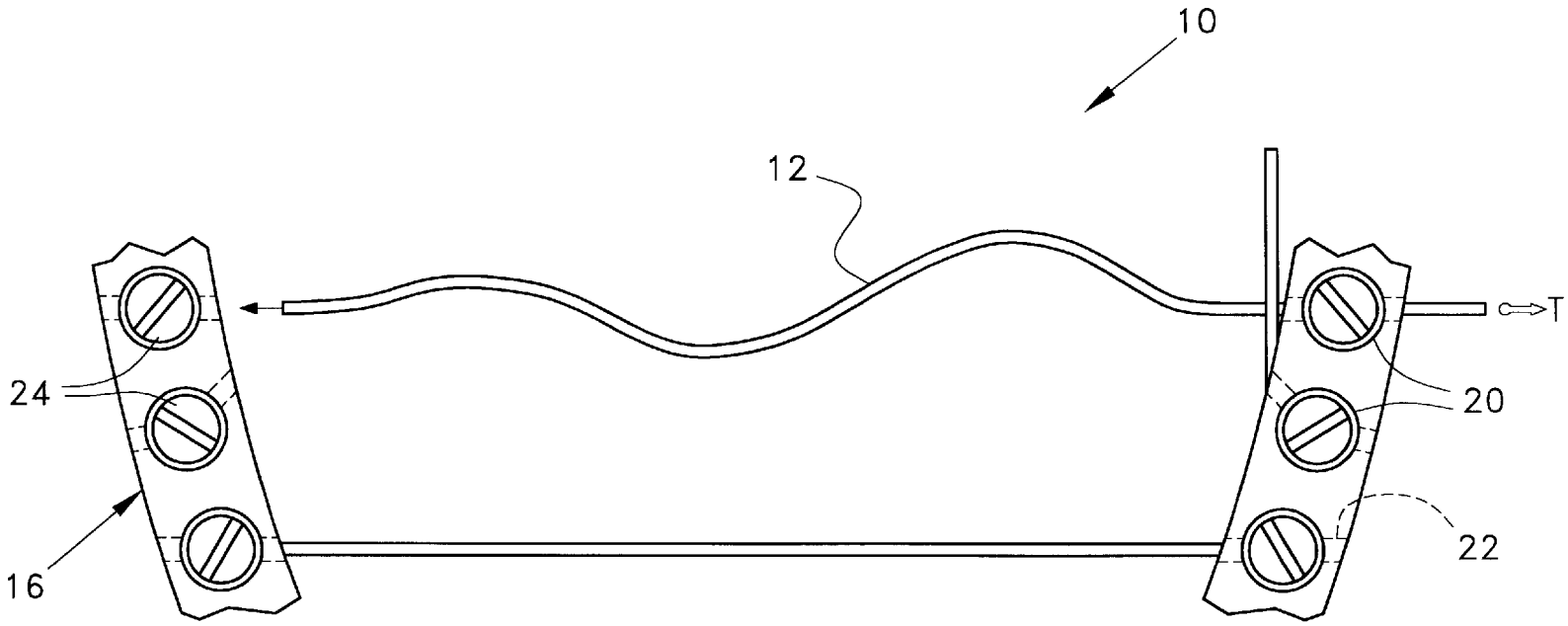
FIG. 2 is an enlarged view of the fragment of the embodiment of FIG. 1 contained within region 2.

Referring to FIG. 2, it can be seen that a screw hole 20 intersects each of the apertures 22 in the head section 16 of the racket 10. The screw holes 20 intersect the apertures 22 at a perpendicular at a point near the midpoint of the length of the aperture 22. The opening defined by the apertures 22 communicates with the opening defined by the screw hole 20. Accordingly the presence of an object in the screw hole 20 would partially obstruct the aperture 22 and object in the aperture 22 would partially obstruct the screw hole 20.

Set screws 24 are disposed within the screw holes, wherein the set screws 24 engage the screw holes 20 with a thread. As the set screws 24 are advanced into the screw holes 20, the set screws 24 obstruct the aperture 22. To place a string 12 in the racket 10, the set screws 24 are retracted to a point where they do not obstruct the aperture 22 they intersect. A segment of string 12 is then placed through the unobstructed apertures 22. The set screw 24 at one end of the string 12 is tightened until the set screw 24 compresses the string 12 in the aperture 22. Once compressed by the set screw 24, the string 12 is physically locked into place and cannot move longitudinally within the aperture 22. Once one end of the string 12 is set in place, the opposite end of the string 12 is pulled taut to a preset tension T from a point external of the racket 10. The tension T can be applied to the string 12 using any one of the many known string tensioning devices that exist in the art of racket stringing. Such tensioning devices are exemplified by U.S. Pat. No. 2,032,217 to Matthews, entitled Tensioning Device.

Once the string 12 is pulled to a desired tension T, the set screw 24 toward the free end of the string 12 is tightened. The set screw 24 intersects the tensioned string 12 in the aperture 22 and locks the string 12 into position within the aperture 22. The string 12 is then locked into position as part of the mesh structure at the preset tension T. The tension device can then be removed and the excess string severed from the exterior of the racket 10. The racket 10 is then ready to for play.

As can be ascertained from the above description, a player need only tighten and loosen the set screws 24 to change any string 12 in the racket 10. The set screws 24 can be loosened or tightened with a screw driver, nut driver or any other conventional tool.

Figure 3:
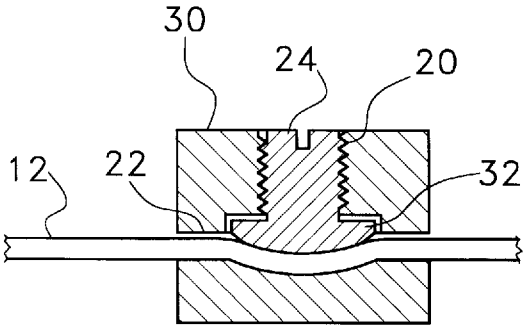
FIG. 3 is a cross-sectional view of the embodiment of FIG. 2, viewed along section line 3—3.

Referring to FIG. 3, it can be seen that the screw hole 20 for each of the set screws 24 intersects the string passage aperture 22 at a point approximately in the middle of the aperture 22. In the embodiment of FIG. 3, the set screw 24 is recessed. In this manner, the head of the screw 24 does not interfere with the face surface 30 of the racket. Accordingly, if a ball were to ever strike the face surface 30 of the racket, the rebound of the ball would not be effected. Additionally, in the embodiment of FIG. 3, the base 32 of the set screw 24 is enlarged and slightly rounded. This configuration increases contact between the set screw 24 and the string 12 and prevents the base 32 of the screw 24 from cutting the string 12 should the set screw 24 be over tightened against the string 12.

Figure 4:
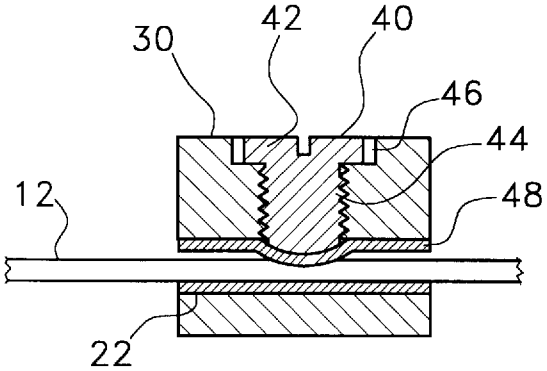
FIG. 4 is an alternate embodiment of the configuration of FIG. 3.

Referring to FIG. 4, an alternate embodiment for the set screw 40 is shown. In this embodiment, the set screw 40 has an enlarged head 42 and a threaded shaft 44. The screw hole for the set screw 40 contains a countersink boring 46 that enables the head 42 of the screw 40 to lay flush with the face surface 30 of the racket. The presence of the countersink boring 46 also prevents the set screw 40 from being over tightened.

In FIG. 4, an optional segment of tubing 48 is shown surrounding the string 12. The tubing 48 defines an opening that is slightly larger than the string 12 and passes around the string 12. The tubing 48 passes into the aperture 22, wherein the set screw 40 is tightened against the tubing 48. The tubing 48 is crushed by the tightening of the set screw 40, wherein the tubing 48 helps protect the string 12 from being cut by the set screw 40 and promotes a greater lock between the set screw 24 and the string 12.

Figure 5:
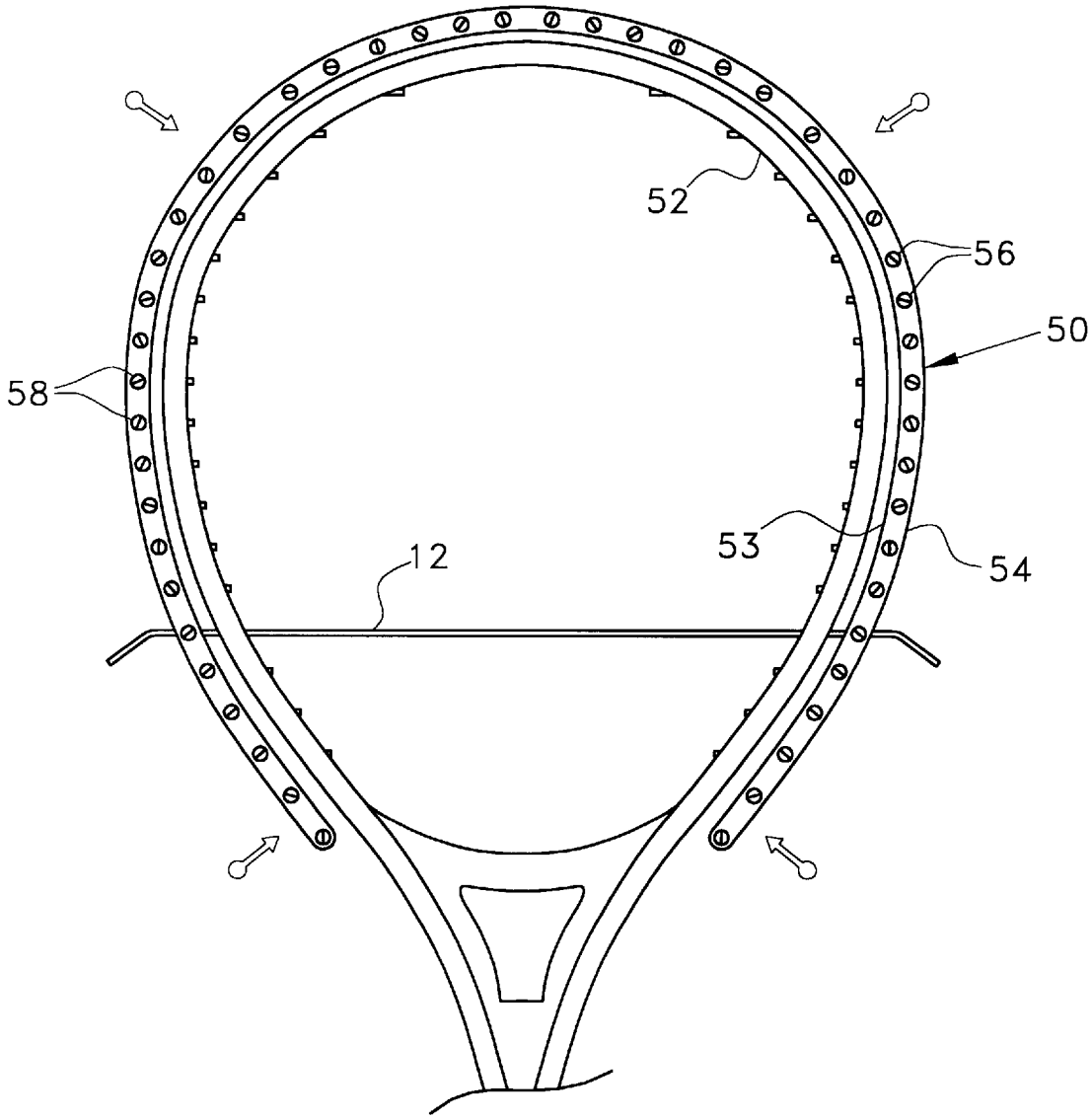
FIG. 5 is front view of a racket assembly in accordance with the present invention.

In the embodiments thus described, the screw holes and set screws were set within the structure of the racket. However, use of the present invention need not require a player to invest in new equipment. Referring to FIG. 5, a string engagement structure 50 is shown that can be added retroactively to most existing prior art rackets. The prior art racket 52 shown has a conventional head section with matched pairs of apertures that extend through the structure of the head section. The apertures align in vertical columns and horizontal rows so as to support a string in a mesh structure. The string engagement structure 50 is a curved element that extends around the exterior periphery of the prior art racket head. The string engagement structure 50 also contains apertures that pass from the interior surface 53 of the string engagement structure 50 to the exterior surface 54. The apertures are periodically placed. Accordingly, when the string engagement structure 50 is placed over the head of a racket 52, the apertures in the string engagement structure 50 will each be proximate an aperture on the head section of the racket 52. Screw holes 56 intersect each of the apertures in the string engagement structure 50. Set screws 58 engage the screw holes 56, wherein the set screws 58 can be used to selectively obstruct the apertures as previously described.

To use the string engagement structure 50, the end of a string 12 is placed in an aperture in the string engagement structure 50. The string 12 is locked into place in the aperture by tightening the set screw 58 above that aperture. The free end of the string 12 is then fed through an aperture in the head section of the racket 52. The string 12 is stretched across the racket and passed through an opposing aperture in the head section. Lastly, the free end of the string 12 is fed through another aperture on the string engagement structure

50. The string 12 is pulled taught to a predetermined tension and the set screw 58 is tightened on the string 12, thereby locking it in place at the predetermined tension.

After the strings 12 are led through the apertures in the string engagement structure 50 and the apertures in the head section of the racket 52, the tension of the strings 12 acts to lock the string engagement structure 50 in place over the head section of the racket. Once biased by the tension of the strings 12, the string engagement structure 50 will not move away from the head section of the racket 52 even if directly impacted by a ball.

It will be understood that the various figures described above illustrate only some preferred embodiment of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. An racket, comprising:

a handle, a frame head extending from said handle, said frame head defining a periphery of a generally oblong area, wherein a plurality of apertures are periodically disposed along said frame head; and a plurality of set screws disposed in said frame head, wherein each of said set screws intersects a separate one of said apertures and selectively obstructs said apertures depending upon the tightened condition of said set screws;

a plurality of strings, each having two ends, wherein each end of each of said strings passes into one of said apertures on said frame head and is held in place in that aperture by one of said set screw.

2. The racket according to claim 1, wherein each of said set screws has a head and a base, and said head of each of said set screws is recessed in said frame head.

3. The racket according to claim 2, wherein said base of said screw is curved.

4. The racket according to claim 2, wherein said base of said screw is enlarged and is larger than said head.

5. The racket according to claim 1, further including a removable segment of tubing positioned in each of said apertures, wherein the ends of each of said strings pass through said tubing in said apertures.

6. The racket according to claim 5, wherein said segment of tubing is capable of being crushed by said set screw in said aperture.

7. In a racket head having a frame that defines the periphery of a generally oblong area, wherein the frame contains a plurality of string apertures, a device for retaining strings in the frame head of a racket, comprising;

at least one structure positionable on an exterior surface of said frame, said at least one structure containing at least one aperture that is positioned proximate at least one of said string apertures in said frame, wherein a string passing through one of said string apertures in said frame can be directed through one of said apertures in said structure; and at least one set screw disposed in said structure, wherein one said set screw intersects each of said apertures in said frame and is capable of being tightened against any segment of string present in said aperture.

8. The device according to claim 7, wherein each of said set screws has a head and a base, and said head of each of said set screws is recessed in said frame.

9. The device according to claim 8, wherein said base of said screw is enlarged and is larger than said head.

10. The device according to claim 9, wherein said base of said screw is curved.

11. The device according to claim 7, further including a removable segment of tubing positioned in said apertures.

12. The device according to claim 11, wherein said segment of tubing is capable of being crushed by said set screw in said aperture.

13. A method of stringing a racket head of the type having a frame that defines the periphery of a generally oblong area, said method comprising the steps of:

providing a plurality of individual strings, each of said strings having two ends;

advancing each end of a string through opposing apertures in said frame, wherein said string spans across said oblong area;

applying a predetermined tension to said string; and engaging said string with a set screw proximate both ends, thereby preventing said string from exiting said opposing apertures and slacking from said predetermined tension.

14. The method according to claim 13, wherein said step of engaging said string includes engaging said string with a set screw at a point external of said frame.

15. The method according to claim 13, wherein said step of engaging said string includes engaging said string with a set screw within said opposing apertures.

16. The method according to claim 13, wherein said step of engaging said string includes compressing a tube around said string with said set screw.

* * * * *